US010066897B2

(12) United States Patent
Hwang et al.

(10) Patent No.: US 10,066,897 B2
(45) Date of Patent: Sep. 4, 2018

(54) EXPANSION BARREL NUT SYSTEMS AND METHODS FOR ATTACHING A HANDGUARD TO AN UPPER RECEIVER OF A FIREARM

(71) Applicant: Fortis Manufacturing, Inc., Kent, WA (US)

(72) Inventors: Paul Sukho Hwang, Puyallup, WA (US); John J. Hwang, Kent, WA (US); Richard Brady Olsen, Yelm, WA (US); Ronald Joseph Hertel, Puyallup, WA (US)

(73) Assignee: Fortis Manufacturing, Inc., Kent, WA (US)

( * ) Notice: Subject to any disclaimer, the term of this patent is extended or adjusted under 35 U.S.C. 154(b) by 0 days.

(21) Appl. No.: 15/350,623

(22) Filed: Nov. 14, 2016

(65) Prior Publication Data

US 2017/0199006 A1 Jul. 13, 2017

Related U.S. Application Data

(60) Provisional application No. 62/277,998, filed on Jan. 13, 2016.

(51) Int. Cl.

| | |
|---|---|
| ***F41A 21/18*** | (2006.01) |
| ***F41C 23/16*** | (2006.01) |
| ***F41A 21/48*** | (2006.01) |
| ***F41A 3/66*** | (2006.01) |
| ***F41A 5/26*** | (2006.01) |
| ***F41A 35/00*** | (2006.01) |

(52) U.S. Cl.
CPC ..... *F41C 23/16* (2013.01); *F41A 3/66* (2013.01); *F41A 5/26* (2013.01); *F41A 21/48* (2013.01); *F41A 35/00* (2013.01)

(58) Field of Classification Search
USPC ..... 89/14.4, 14.5, 194; 42/75.01, 75.02; 181/223
See application file for complete search history.

(56) References Cited

U.S. PATENT DOCUMENTS

| | | | | | |
|---|---|---|---|---|---|
| 2,836,918 | A * | 6/1958 | Pula | F41A 17/44 | 138/89 |
| 3,193,959 | A * | 7/1965 | Jaycox | F41A 17/44 | 42/70.11 |
| 3,360,880 | A * | 1/1968 | Finnegan | F41A 17/44 | 42/66 |
| 4,406,182 | A * | 9/1983 | Antone | B67B 7/066 | 29/266 |
| 4,474,302 | A * | 10/1984 | Goldberg | B65D 39/0017 | 215/256 |
| 4,512,099 | A * | 4/1985 | Mathew | F41A 17/44 | 42/70.11 |
| 4,765,224 | A * | 8/1988 | Morris | F41A 5/26 | 42/75.02 |

(Continued)

*Primary Examiner* — Michael D David
(74) *Attorney, Agent, or Firm* — Eversheds Sutherland (US) LLP

(57) ABSTRACT

A barrel nut assembly for a firearm is disclosed. The barrel nut assembly may include a barrel nut comprising a plurality of expansion flanges. The barrel nut assembly also may include an expansion plug comprising an expansion surface. The expansion surface may be configured to abut and expand the plurality of expansion flanges when the expansion plug is attached to the barrel nut.

11 Claims, 6 Drawing Sheets

(56) References Cited

U.S. PATENT DOCUMENTS 5,048,211 A * 9/1991 Hepp ..... F41A 17/44 42/70.11
5,115,589 A * 5/1992 Shuker ..... F41A 17/44 42/70.11
5,138,785 A * 8/1992 Paterson ..... F41A 17/44 42/66
5,171,924 A * 12/1992 Honey ..... F41A 17/44 42/66
5,241,770 A * 9/1993 Lambert ..... F41A 17/44 42/70.11
5,289,653 A * 3/1994 Szebeni ..... F41A 17/44 42/70.11
5,412,895 A * 5/1995 Krieger ..... F41A 21/482 42/75.02
D361,819 S * 8/1995 Serrao ..... D22/100
5,475,994 A * 12/1995 Briley, Jr. ..... F41A 17/44 42/70.11
5,664,358 A * 9/1997 Haber ..... F41A 17/44 42/44
5,732,498 A * 3/1998 Arreguin ..... F41A 17/44 42/70.02
5,732,499 A * 3/1998 Canaday ..... F41A 15/12 42/75.02
5,950,344 A * 9/1999 Ross ..... F41A 17/44 42/70.11
6,584,718 B1 * 7/2003 Serrao ..... F41A 17/02 42/44
6,671,990 B1 * 1/2004 Booth ..... F41C 23/16 42/75.01
6,912,807 B2 * 7/2005 Meyerle ..... F41A 17/06 42/70.11
7,150,122 B1 * 12/2006 Ha ..... F41A 17/44 42/70.11
7,464,496 B1 * 12/2008 Davies ..... F41A 21/24 42/75.02
D631,312 S * 1/2011 Wallimann-Durrer ..... D8/29.1
D648,606 S * 11/2011 Sallander ..... D8/29.1
8,272,306 B1 * 9/2012 Smith ..... F41A 21/30 181/223
8,296,987 B1 * 10/2012 Dlubak ..... F41A 21/08 42/75.01
8,387,299 B1 * 3/2013 Brittingham ..... F41A 21/30 42/90
8,424,441 B2 * 4/2013 Brittingham ..... F41A 21/30 181/223
8,677,668 B1 * 3/2014 Caldwell ..... F41A 17/44 42/66
8,726,559 B1 * 5/2014 Mueller ..... F41A 21/482 42/75.02
8,739,674 B1 * 6/2014 Huber ..... F41A 21/32 89/14.2
8,806,792 B2 * 8/2014 Yan ..... F41C 23/16 42/71.01
8,863,426 B1 * 10/2014 Zinsner ..... F41C 23/16 42/71.01
9,239,204 B2 * 1/2016 Michal ..... F41A 35/04
9,372,041 B1 * 6/2016 Geissele ..... F41A 11/00
9,448,027 B1 * 9/2016 Zinsner ..... F41A 21/482
9,505,009 B1 * 11/2016 Wein ..... B02C 18/186
D789,480 S * 6/2017 Olsen ..... D22/108
9,784,517 B2 * 10/2017 Pittman ..... F41A 17/02
9,803,944 B2 * 10/2017 Pittman ..... F41A 17/02
2007/0017139 A1 * 1/2007 Larue ..... F41A 21/482 42/75.1
2010/0162604 A1 * 7/2010 Dubois ..... F41A 11/02 42/18
2010/0319231 A1 * 12/2010 Stone ..... F41C 23/16 42/71.01
2011/0000122 A1 * 1/2011 Camarillo ..... F41A 35/04 42/96
2011/0036233 A1 * 2/2011 DeGroat ..... F41A 21/325 89/14.4
2011/0252952 A1 * 10/2011 McNeill ..... F41A 21/38 89/14.3
2012/0102805 A1 * 5/2012 Buxton ..... F16B 37/047 42/90
2012/0131835 A1 * 5/2012 Barrett ..... F41A 3/26 42/75.02
2014/0115938 A1 * 5/2014 Jarboe ..... F41A 21/485 42/71.01
2015/0007478 A1 * 1/2015 Barrett ..... F41A 21/481 42/75.02
2015/0090105 A1 * 4/2015 Pace ..... F41A 21/30 89/14.4
2015/0247700 A1 * 9/2015 Merlino ..... F41C 23/16 42/75.01
2015/0316347 A1 * 11/2015 Shea ..... F41C 23/16 42/75.02
2016/0003566 A1 * 1/2016 Gomirato ..... F41A 5/28 89/193
2016/0003570 A1 * 1/2016 Tonkin ..... F41A 21/02 89/14.4
2016/0010938 A1 * 1/2016 Merkley ..... F41A 21/482 42/75.02
2016/0054096 A1 * 2/2016 Dzwill ..... F41C 23/16 42/75.02
2016/0116251 A1 * 4/2016 Mather ..... F41A 21/482 42/71.01
2017/0191779 A1 * 7/2017 Myers ..... F41A 21/30

* cited by examiner

DETAIL B

SECTION E-E

DETAIL B

EXPANSION BARREL NUT SYSTEMS AND METHODS FOR ATTACHING A HANDGUARD TO AN UPPER RECEIVER OF A FIREARM

CROSS-REFERENCE TO RELATED APPLICATIONS

The disclosure claims priority to and the benefit of U.S. provisional application No. 62/277,998, filed Jan. 13, 2016, which is incorporated by reference herein in its entirety.

FIELD OF THE DISCLOSURE

The disclosure generally relates to firearms and more particularly relates to expansion barrel nut systems and methods for attaching a handguard to an upper receiver of a firearm.

BACKGROUND

Typical barrel nuts comprise convoluted attachment mechanisms that include a number of screws and/or bolts to attach a handguard to an upper receiver of a firearm.

SUMMARY

Some or all of the above needs and/or problems may be addressed by certain embodiments of a barrel nut assembly for a firearm disclosed herein. According to an embodiment, the barrel nut assembly may include a barrel nut comprising a plurality of expansion flanges. The barrel nut assembly also may include an expansion plug comprising an expansion surface. The expansion surface may be configured to abut and expand the plurality of expansion flanges when the expansion plug is attached to the barrel nut.

Other features and aspects of the barrel nut assembly will be apparent or will become apparent to one with skill in the art upon examination of the following figures and the detailed description. All other features and aspects, as well as other system, method, and assembly embodiments, are intended to be included within the description and are intended to be within the scope of the accompanying claims.

BRIEF DESCRIPTION OF THE DRAWINGS

The detailed description is set forth with reference to the accompanying drawings. The use of the same reference numerals may indicate similar or identical items. Various embodiments may utilize elements and/or components other than those illustrated in the drawings, and some elements and/or components may not be present in various embodiments. Elements and/or components in the figures are not necessarily drawn to scale. Throughout this disclosure, depending on the context, singular and plural terminology may be used interchangeably.

DETAILED DESCRIPTION

Figure 1:
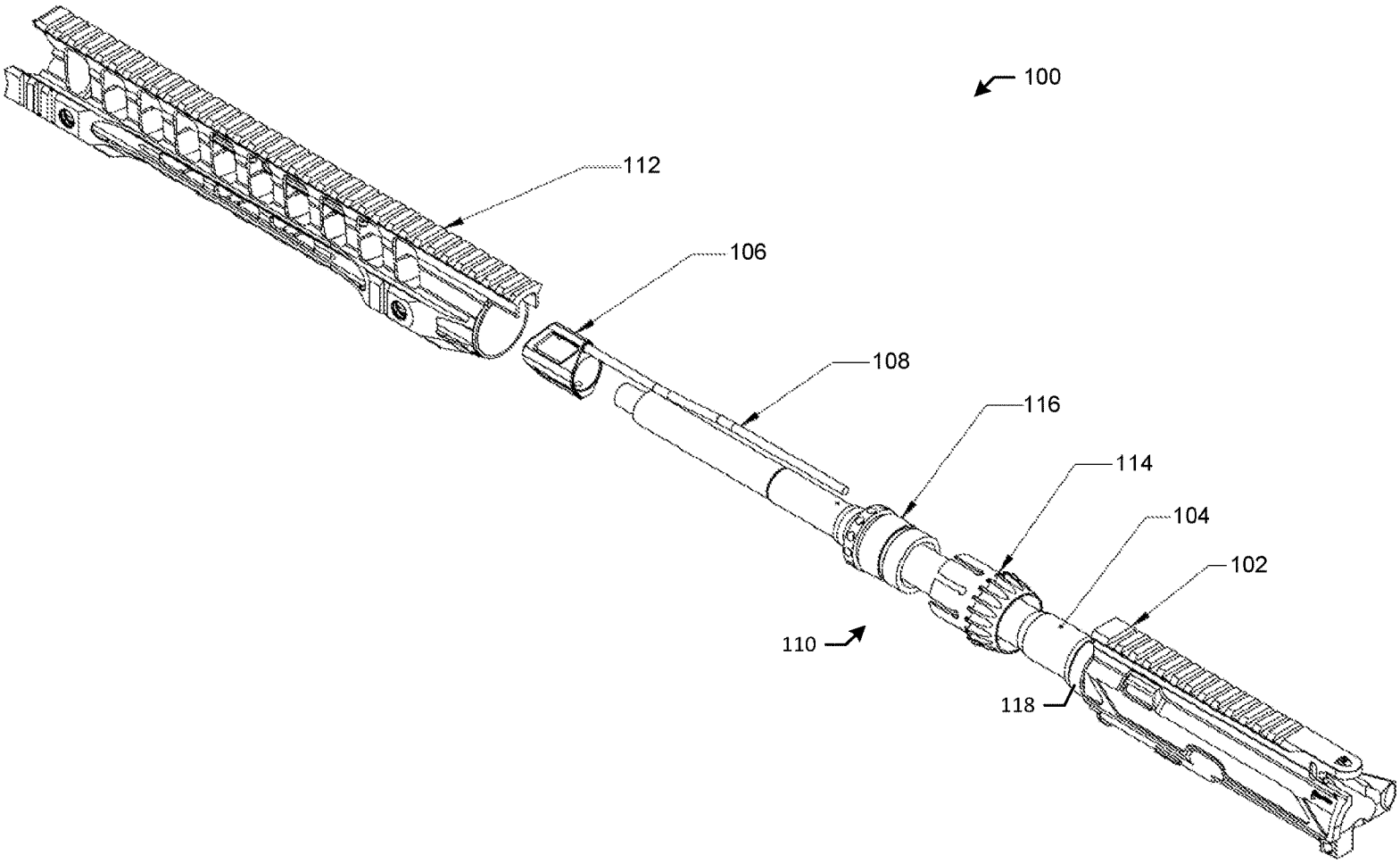
FIG. 1 depicts an exploded view of an attachment assembly in accordance with one or more embodiments of the disclosure.

Described below are embodiments of a barrel nut assembly (as well as individual components of the barrel nut assembly) for attaching a handguard to a firearm. Methods of installing and using the barrel nut assembly on the firearm are also disclosed. The firearm may be a conventional firearm. For example, the firearm may be an M-16 style rifle, an AR-15 style rifle, an AR-10 style rifle, or an M-4 style rifle, among others. Any type of firearm may be used. The firearm may include, among other things, an upper receiver, a barrel, a gas block, and a gas tube extending from the gas block. In some instances, the barrel nut assembly may be used to attach a handguard (or other type of rail) to the upper receiver about the barrel, the gas block, and the gas tube. For example, the barrel nut assembly may include a barrel nut and an expansion plug for attaching the handguard to the upper receiver.

The upper receiver may include a threaded extension. The barrel nut may include a corresponding threaded bore that can be threaded onto the threaded extension of the upper receiver. The barrel nut also may include a front end, a rear end, an internal flange that separates the threaded bore into front threads and rear threads, a number of grooves disposed on the rear end, a number of expansion flanges disposed on the front end, and a number of slots disposed between the expansion flanges. In some instances, the slots may be keyhole slots or the like. The internal flange, grooves, expansion flanges, and slots may be any size, shape, or configuration.

In some instances, the grooves may be evenly spaced about the rear end of the barrel nut. The grooves may be any size, shape, or configuration. Any number of grooves may be used. In some instances, the grooves may extend axially along an outer surface of the barrel nut. The grooves may be configured to mate with a complementary gripping structure (such as one or more lugs or the like) on a wrench or other tool. In this manner, the grooves may be used to tighten the barrel nut to the threaded extension on the upper receiver. In some instances, the rear threads in the threaded bore of the barrel nut may be attached to the threaded extension on the upper receiver.

The expansion plug may include a front end, a rear end, a bore, a number of apertures disposed on the front end, external threads disposed on the rear end, and an expansion surface disposed between the front end and the rear end. An outer radius of the expansion surface may increase from rear to front. As a result, the expansion surface may be configured to abut and outwardly expand the expansion flanges of the barrel nut when the external threads of the expansion plug are threaded into the threaded bore of the barrel nut. For example, the external threads of the expansion plug may be threaded into the front threads in the threaded bore of the barrel nut. In certain embodiments, the expansion flanges of the barrel nut may include an internal chamfer to facilitate engagement with the expansion surface of the expansion plug.

The apertures may be evenly spaced about the front end of the expansion plug. The apertures may be any size, shape, or configuration. Any number of apertures may be used. In some instances, the apertures may extend radially between an outer surface and the bore of the expansion plug. The apertures may be configured to mate with a complementary gripping structure (such as one or more lugs or the like) on a wrench or other tool. In this manner, the apertures may be used to tighten the external threads of the expansion plug into the front threads in the threaded bore of the barrel nut, which may cause the expansion surface to abut and outwardly expand the expansion flanges of the barrel nut.

In order to secure the handguard to the upper receiver, the handguard may be positioned about the expansion flanges of the barrel nut. In this manner, the expansion flanges of the barrel nut may expand against the hand guard to secure the handguard in place when the external threads of the expansion plug are threaded into the front threads in the threaded bore of the barrel nut. That is, the expansion surface may push or expand the expansion flanges of the barrel nut against an inner surface of the handguard, which may lock the handguard in place. The handguard may be any size, shape, or configuration.

In some instances, the gas tube may extend from the gas block through one of the grooves on the barrel nut. For example, the gas tube may pass through the upper most groove (i.e., the groove located at the 12 o'clock position) when the barrel nut is attached to the upper receiver. Similarly, the handguard may include a rail having two protrusions that extend through two of the grooves. The rail may be any size, shape, or configuration. In some instances, the rail protrusions may extend through the grooves located on either side of the groove the gas tube passes through. In certain embodiments, the grooves on the barrel nut may form a circumferential slot, in which a portion of the handguard may nest.

These and other embodiments of the disclosure will be described in more detail through reference to the accompanying drawings in the detailed description of the disclosure that follows. This brief introduction, including section titles and corresponding summaries, is provided for the reader's convenience and is not intended to limit the scope of the claims or the proceeding sections. Furthermore, the techniques described above and below may be implemented in a number of ways and in a number of contexts. Several example implementations and contexts are provided with reference to the following figures, as described below in more detail. However, the following implementations and contexts are but a few of many.

As depicted in FIG. 1, the firearm 100 may include, among other things, an upper receiver 102, a barrel 104, a gas block 106, and a gas tube 108 extending from the gas block 106. The gas block 106 may be disposed about the barrel 104. A barrel nut assembly 110 may be used to attach a handguard 112 (or other type of rail system) to the upper receiver 102 about the barrel 104, the gas block 106, and the gas tube 108. The barrel nut assembly 110 may include a barrel nut 114 and an expansion plug 116 for attaching the handguard 112 to the upper receiver 102. The barrel nut 114 and the expansion plug 116 may be positioned around the barrel 104.

Figure 2:
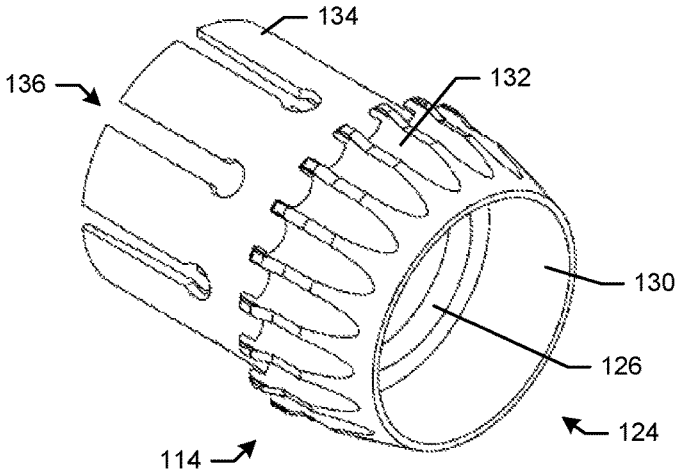
FIG. 2 depicts a perspective view of a barrel nut in accordance with one or more embodiments of the disclosure.
Figure 3:
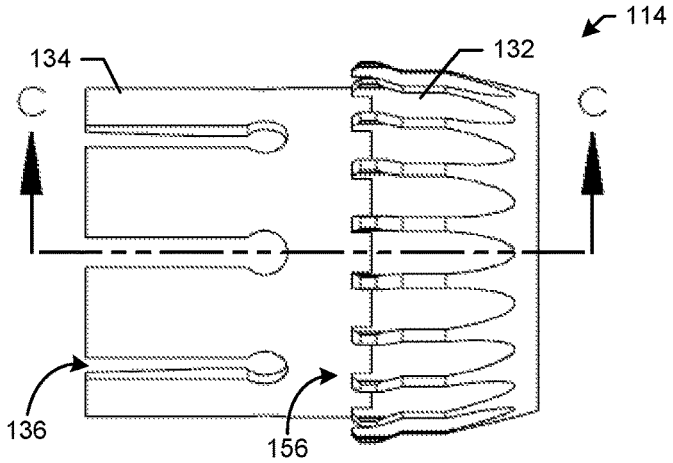
FIG. 3 depicts a side view of a barrel nut in accordance with one or more embodiments of the disclosure.
Figure 4:
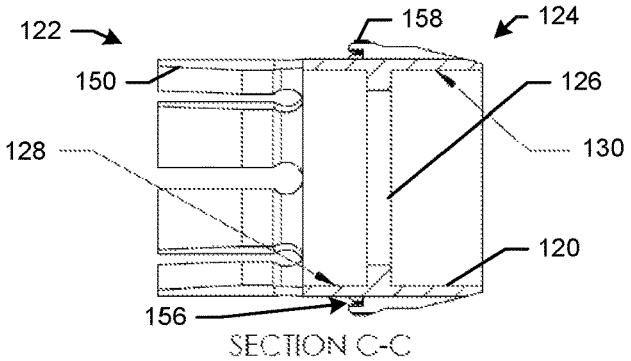
FIG. 4 depicts a cross-sectional view of a barrel nut in accordance with one or more embodiments of the disclosure.

The upper receiver 102 may include a threaded extension 118. As depicted in FIGS. 2-4, the barrel nut 114 may include a corresponding threaded bore 120 that can be threaded onto the threaded extension 118 of the upper receiver 102. The barrel nut 114 also may include a front end 122 and a rear end 124. An internal flange 126 may be disposed within the threaded bore 120. The internal flange 126 may extend around the entire inner circumference of the barrel nut 114. The internal flange 126 may separate the threaded bore 120 into front threads 128 and rear threads 130. The barrel nut 114 may include a number of grooves 132 disposed about the rear end 124. As discussed below, the grooves 132 may be used to tighten the barrel nut 114 to the upper receiver 102. A number of expansion flanges 134 may be disposed on the front end 122 of the barrel nut 114. The expansion flanges 134 may comprise resilient flaps or the like configured to expand radially outward when a force is applied thereto. The expansion flanges 134 may be spaced apart by a number of slots 136 disposed between the expansion flanges 134. In some instances, the slots 136 may be keyhole slots or the like. Any number of expansion flanges 134 and slots 136 may be used. The expansion flanges 134 and slots 136 may be any size, shape, or configuration. In certain embodiments, as discussed below, the ends of the expansion flanges 136 may include one or more locking lips 160 that engage a locking groove 162 on the inside of the handguard 112.

In some instances, the grooves 132 may be evenly spaced about the rear end 124 of the barrel nut 114 in a circumferential array. The grooves 132 may be any size, shape, or configuration. Any number of grooves 132 may be used. In some instances, the grooves 132 may extend axially along an outer surface of the barrel nut 114. The grooves 132 may be configured to mate with a complementary gripping structure (such as one or more lugs or the like) on a wrench or other tool. In this manner, the grooves 132 may be used to tighten the barrel nut 114 to the threaded extension 118 on the upper receiver 102. In some instances, the rear threads 130 in the threaded bore 120 of the barrel nut 114 may be attached to the threaded extension 118 on the upper receiver 102.

Figure 5:
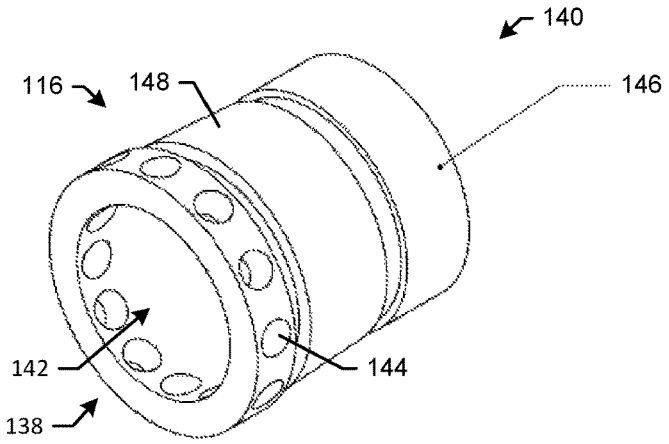
FIG. 5 depicts a perspective view of an expansion plug in accordance with one or more embodiments of the disclosure.
Figure 6:
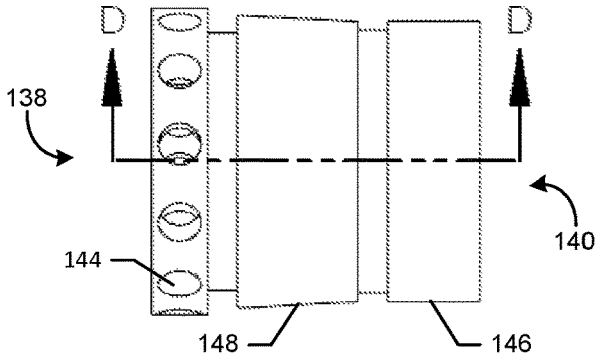
FIG. 6 depicts a side view of an expansion plug in accordance with one or more embodiments of the disclosure.
Figure 7:
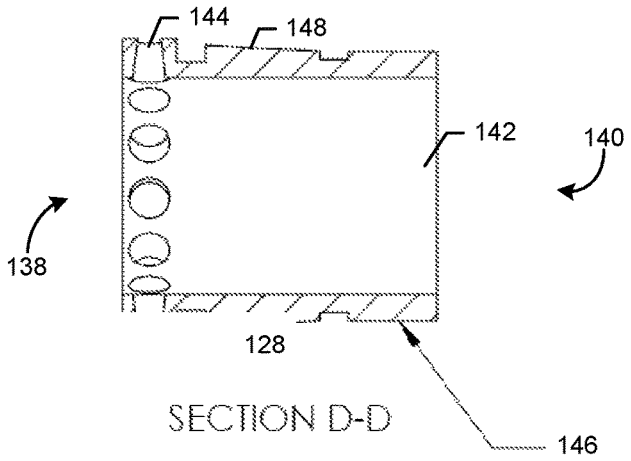
FIG. 7 depicts a cross-sectional view of an expansion plug in accordance with one or more embodiments of the disclosure.

As depicted in FIGS. 5-7, the expansion plug 116 may include a front end 138 and a rear end 140. A bore 142 may pass through the expansion plug 116. In some instances, a number of apertures 144 disposed on the front end 138 of the expansion plug 116 and external threads 146 may be disposed on the rear end 140 of the expansion plug 116. As discussed below, the apertures 144 and external threads 146 may be used to attach the expansion plug 116 to the barrel nut 114. The expansion plug 116 may include an expansion surface 148 disposed between the front end 138 and the rear end 140 of the expansion plug 116. The expansion surface 148 may extend about the circumference of the expansion plug 116. An outer radius of the expansion surface 148 may increase from rear to front. That is, the expansion surface 148 may be sloped. As a result, the expansion surface 148 may be configured to abut and outwardly expand the expansion flanges 134 of the barrel nut 114 when the external threads 146 of the expansion plug 116 are threaded into the threaded bore 120 of the barrel nut 114. For example, the external threads 146 of the expansion plug 116 may be threaded into the front threads 128 in the threaded bore 120 of the barrel nut 114. In certain embodiments, as depicted in FIG. 4, the expansion flanges 134 of the barrel nut 114 may include an internal chamfer 150 to facilitate engagement with the expansion surface 148 of the expansion plug 116.

Referring back to FIGS. 5-7, the apertures 144 may be evenly spaced about the front end 138 of the expansion plug 116 in a circumferential array. The apertures 144 may be any size, shape, or configuration. Any number of apertures 144 may be used. In some instances, the apertures 144 may extend radially between an outer surface of the expansion plug 116 and the bore 142 of the expansion plug 116. The apertures 144 may be configured to mate with a complementary gripping structure (such as one or more lugs or the like) on a wrench or other tool. In this manner, the apertures 144 may be used to tighten the external threads 146 of the expansion plug 116 into the front threads 128 in the threaded bore 120 of the barrel nut 114, which may cause the expansion surface 148 to abut and outwardly expand the expansion flanges 134 of the barrel nut 144.

Figure 8:
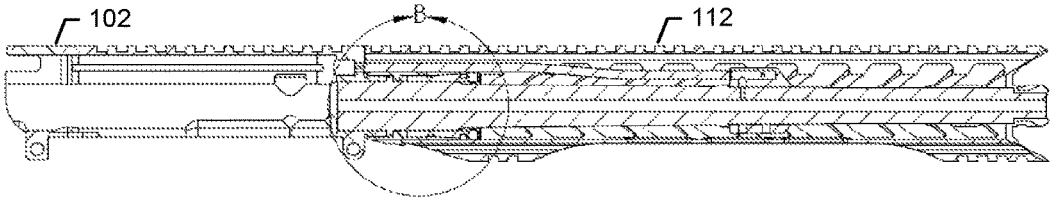
FIG. 8 depicts a cross-sectional view of an attachment assembly in accordance with one or more embodiments of the disclosure.
Figure 9:
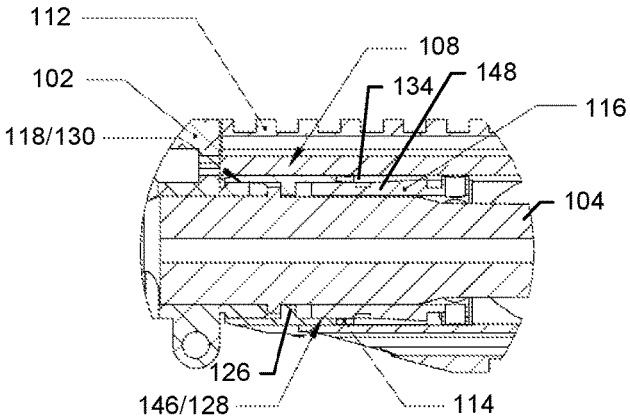
FIG. 9 depicts a cross-sectional view of an attachment assembly in accordance with one or more embodiments of the disclosure.

In order to secure the handguard 112 to the upper receiver 102, as depicted in FIGS. 8 and 9, the handguard 112 may be positioned around the expansion flanges 134 of the barrel nut 114. In this manner, the expansion flanges 134 of the barrel nut 114 may expand outward against the handguard 112 to secure the handguard 112 in place when the external threads 146 of the expansion plug 116 are threaded into the front threads 128 in the threaded bore 120 of the barrel nut 114. That is, the expansion surface 148 may push or expand the expansion flanges 134 of the barrel nut 114 radially outward against an inner surface of the handguard 112, which may lock the handguard 112 in place. The handguard 112 may be any size, shape, or configuration.

Figure 10:
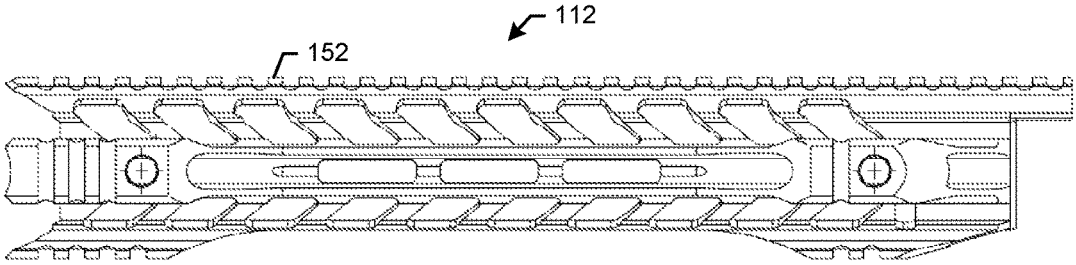
FIG. 10 depicts a side view of a handguard in accordance with one or more embodiments of the disclosure.
Figure 11:
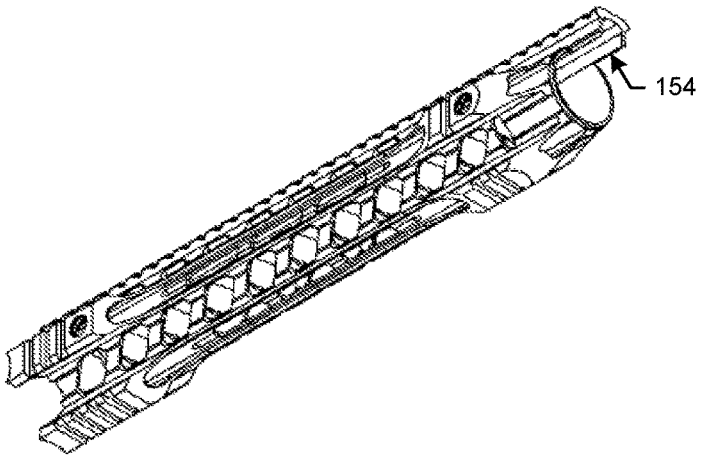
FIG. 11 depicts a perspective view of a handguard in accordance with one or more embodiments of the disclosure.

In some instances, the gas tube 108 may extend from the gas block 106 through one of the grooves 132 on the barrel nut 114. For example, the gas tube 108 may pass through the upper most groove (i.e., the groove located at the 12 o'clock position) when the barrel nut 114 is attached to the upper receiver 102. Similarly, as depicted in FIGS. 10 and 11, the handguard 112 may include a rail 152 having two protrusions 154 extending from an end of the handguard 112 that abuts the upper receiver 102 when attached thereto. The two protrusions 154 that may extend through two of the grooves 132. In some instances, the two protrusions 154 may extend through the grooves 132 located on either side of the groove 132 that the gas tube 108 passes through. In some instances, the rail 152 may be a Picatinny rail, a Weaver rail, an M-LOK rail, a Keymod rail, etc. Any type of rail or bracket may be used. The rail 152 may be any size, shape, or configuration. Moreover, the handguard 112 may be any type of rail system or firearm accessory. That is, the barrel nut assembly 110 may be used to attach any rail, handguard, or other firearm accessory to the upper receiver 102. In this manner, the term handguard as used herein may refer to any number of firearm components or accessories that are attachable to the upper receiver 102 by the barrel nut assembly 110.

Referring back to FIGS. 2-4, in certain embodiments, the grooves 132 on the barrel nut 114 may form a slot 156, in which a portion of the handguard 112 may nest. In some instances, the slot 156 may be a circumferential slot. The slot 156 may be formed by one or more forward extending protrusions 158, which at least partially form the grooves 132. The slot 156 and protrusions 158 may be any size, shape, or configuration.

Figure 12:
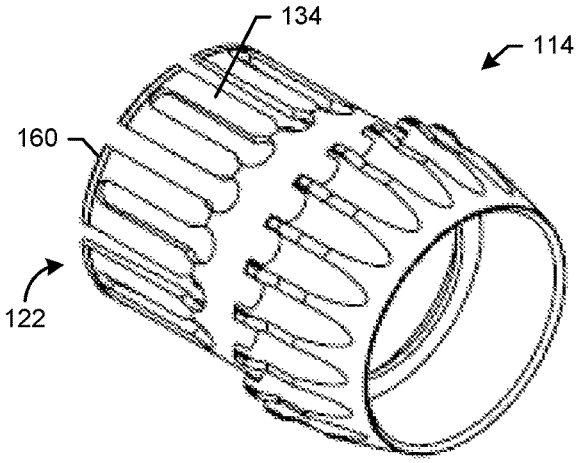
FIG. 12 depicts a perspective view of a barrel nut in accordance with one or more embodiments of the disclosure.
Figure 13:
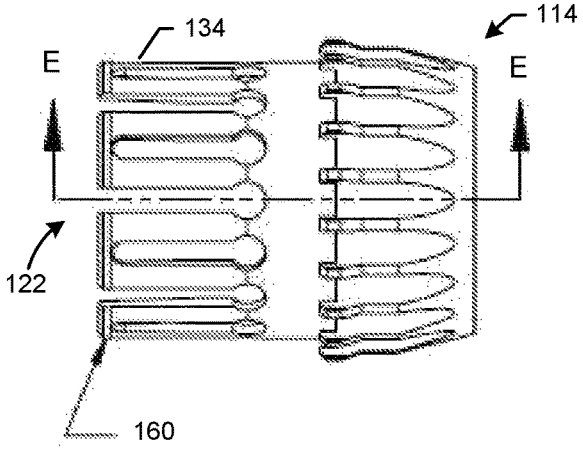
FIG. 13 depicts a side view of a barrel nut in accordance with one or more embodiments of the disclosure.
Figure 14:
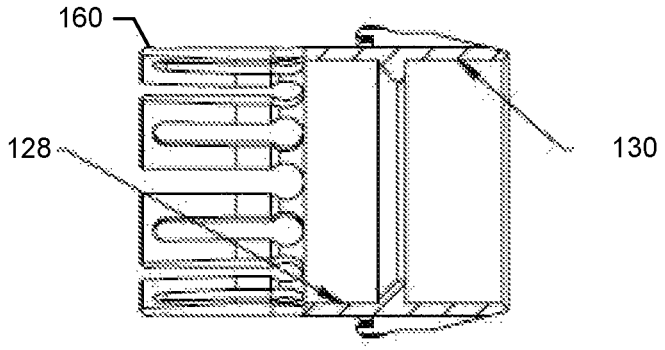
FIG. 14 depicts a cross-sectional view of a barrel nut in accordance with one or more embodiments of the disclosure.
Figure 15:
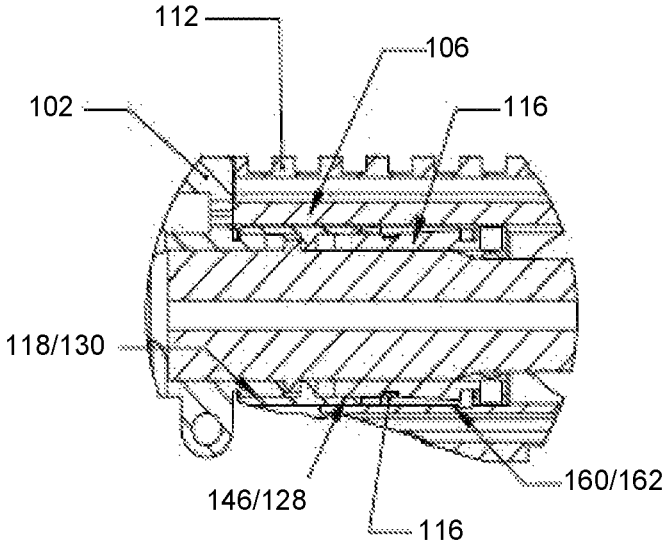
FIG. 15 depicts a cross-sectional view of an attachment assembly in accordance with one or more embodiments of the disclosure.

FIGS. 12-14 depict the barrel nut 114 having a locking lip 160 on the front end 122. In some instances, the locking lip 160 may be disposed at the distal end of the expansion flanges 134. The locking lip 160 may be located on any exterior surface of the barrel nut 114. In some instances, the locking lip 160 may be a single circumferential lip or a number of lips. As depicted in FIG. 15, the locking lip 160 may mate with a corresponding locking groove 162 on the inside of the handguard 112 as the expansion flanges 134 expand radially outward. The locking groove 162 may comprise a circumferential channel or the like. In this manner, the locking lip 160 and the locking groove 160 prevents the handguard 112 front moving forward or backward from vibrations, firing, or other movement.

Although specific embodiments of the disclosure have been described, numerous other modifications and alternative embodiments are within the scope of the disclosure. For example, any of the functionality described with respect to a particular device or component may be performed by another device or component. Further, while specific device characteristics have been described, embodiments of the disclosure may relate to numerous other device characteristics. Further, although embodiments have been described in language specific to structural features and/or methodological acts, it is to be understood that the disclosure is not necessarily limited to the specific features or acts described. Rather, the specific features and acts are disclosed as illustrative forms of implementing the embodiments. Conditional language, such as, among others, "can," "could," "might," or "may," unless specifically stated otherwise, or otherwise understood within the context as used, is generally intended to convey that certain embodiments could include, while other embodiments may not include, certain features, elements, and/or steps. Thus, such conditional language is not generally intended to imply that features, elements, and/or steps are in any way required for one or more embodiments.

That which is claimed is:

1. A rail attachment system for a firearm, comprising:

an upper receiver comprising a threaded extension;

a barrel nut comprising a front end, a rear end, a threaded bore, an internal flange, a plurality of grooves disposed on the rear end, and a plurality of expansion flanges disposed on the front end, wherein the threaded bore is threaded onto the threaded extension;

an expansion plug comprising a front end, a rear end, a bore, a plurality of apertures disposed on the front end, external threads disposed on the rear end, and an expansion surface disposed between the front end and the rear end, wherein the expansion surface is configured to abut and expand the plurality of expansion flanges when the external threads of the expansion plug are threaded into the threaded bore of the barrel nut; and a handguard positioned about the plurality of expansion flanges, wherein the plurality of expansion flanges expand against the handguard to secure the handguard in place when the external threads of the expansion plug are threaded into the threaded bore of the barrel nut.

2. The system of claim 1, further comprising:

a barrel;

a gas block attached to the barrel; and a gas tube extending from the gas block through one of the plurality of grooves.

3. The system of claim 1, further comprising a rail disposed on the handguard, wherein at least a portion of the rail extends through two of the plurality of grooves.

4. The system of claim 1, further comprising a plurality of slots disposed between the plurality of expansion flanges.

5. The system of claim 4, wherein the plurality of slots comprise keyhole slots.

6. The system of claim 1, wherein the internal flange separates the threaded bore into front threads and rear threads.

7. The system of claim 6, wherein the external threads of the expansion plug are threaded into the front threads, and wherein the rear threads are threaded onto the threaded extension.

8. The system of claim 1, wherein the plurality of grooves are evenly spaced about the rear end.

9. The system of claim 1, wherein the plurality of expansion flanges comprises an internal chamfer.

10. The system of claim 1, wherein an outer radius of the expansion surface increases from rear to front.

11. The system of claim 1, wherein the plurality of apertures are evenly spaced about the front end.

* * * * *